US005655761A

United States Patent [19]

Sanchez

[11] Patent Number: 5,655,761

[45] Date of Patent: Aug. 12, 1997

[54] REVERSIBLE SHEET FEEDER ACCUMULATOR

[75] Inventor: Jose R. Sanchez, Briarcliff Manor, N.Y.

[73] Assignee: Pitney Bowes Inc., Stamford, Conn.

[21] Appl. No.: 451,589

[22] Filed: May 26, 1995

[51] Int. Cl.[6] ..... B65H 5/22

[52] U.S. Cl. ..... 271/4.09; 271/3.08; 271/245; 271/121; 271/4.01; 271/212; 271/213; 414/788.9; 414/789; 414/794.9; 414/795; 414/906

[58] Field of Search ..... 271/3.08, 4.09, 271/4.01, 121, 245, 212, 213; 414/788.9, 789, 794.9, 795, 906

[56] References Cited

U.S. PATENT DOCUMENTS

| | | | |
|---|---|---|---|
| 3,777,903 | 12/1973 | Kuckhermann | 271/212 |
| 4,465,272 | 8/1984 | Kajita et al. | 271/245 |
| 5,000,657 | 3/1991 | Gunther, Jr. | 414/789 |
| 5,022,641 | 6/1991 | Okada | 271/3.08 |
| 5,078,383 | 1/1992 | Shiina et al. | 271/212 |
| 5,147,092 | 9/1992 | Driscoll et al. | 271/245 |
| 5,244,200 | 9/1993 | Manzke | 271/212 |

*Primary Examiner*—William E. Terrell
*Assistant Examiner*—Khoi H. Tran
*Attorney, Agent, or Firm*—Christopher J. Capelli; Melvin J. Scolnick; David E. Pitchenik

[57] ABSTRACT

Apparatus for accumulating paper sheets singulated from a paper sheet feeder on a registration deck. The apparatus includes: a sheet feeder for feeding the topmost paper sheet from a stack of paper sheets; an accumulator having an accumulation deck for receiving the sheets of paper from the sheet feeder; a registration stop for stopping the advance of the paper sheets along the accumulation deck; a deflector downstream of the sheet feeder and above the accumulation deck; and a pair of top and bottom rollers defining a nip, the nip being located adjacent, upstream and above the deflector and downstream of the sheet feeder. The top roller is formed from a foam, and the distance between the registration stop and the deflector is less than the length of the paper sheets, whereby each sheet fed from the sheet feeder is stopped by the registration stop and the trailing edge of the stopped sheet is kicked up by the deflector off the accumulation deck and is raised further off the accumulation deck by the top, foam roller, and whereby the paper sheets accumulate on the accumulation deck in the same order as when the sheets were in the sheet feeder.

6 Claims, 3 Drawing Sheets

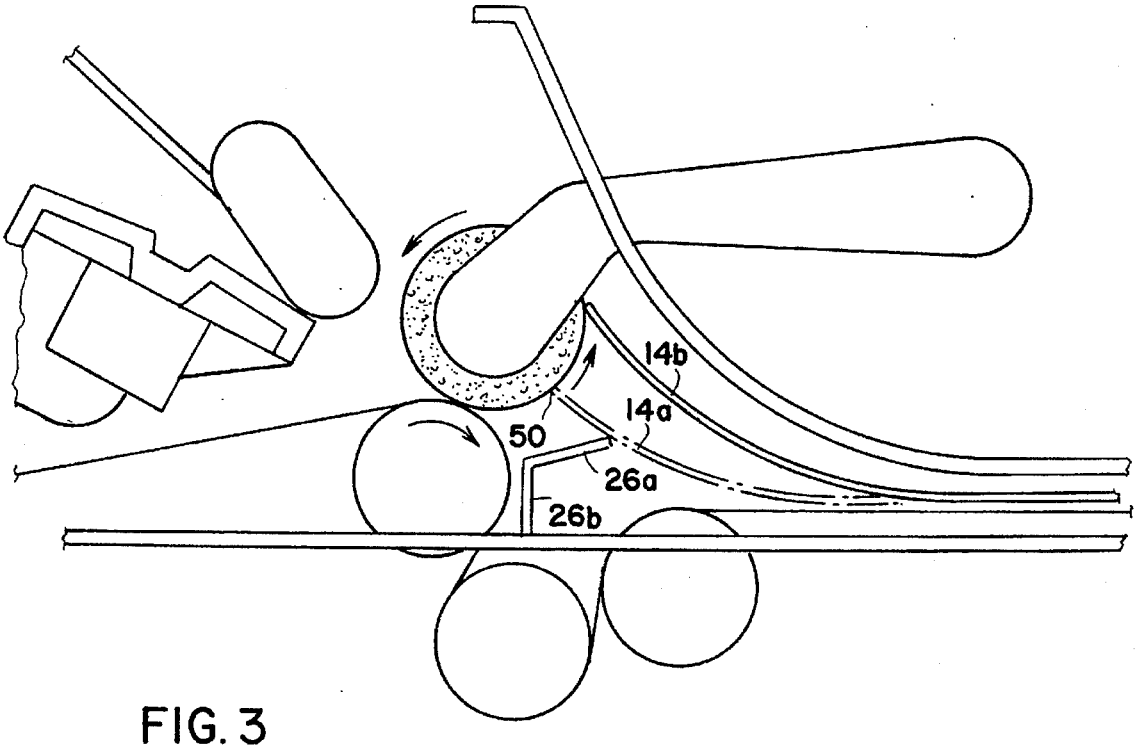
FIG. 3
FIG. 4
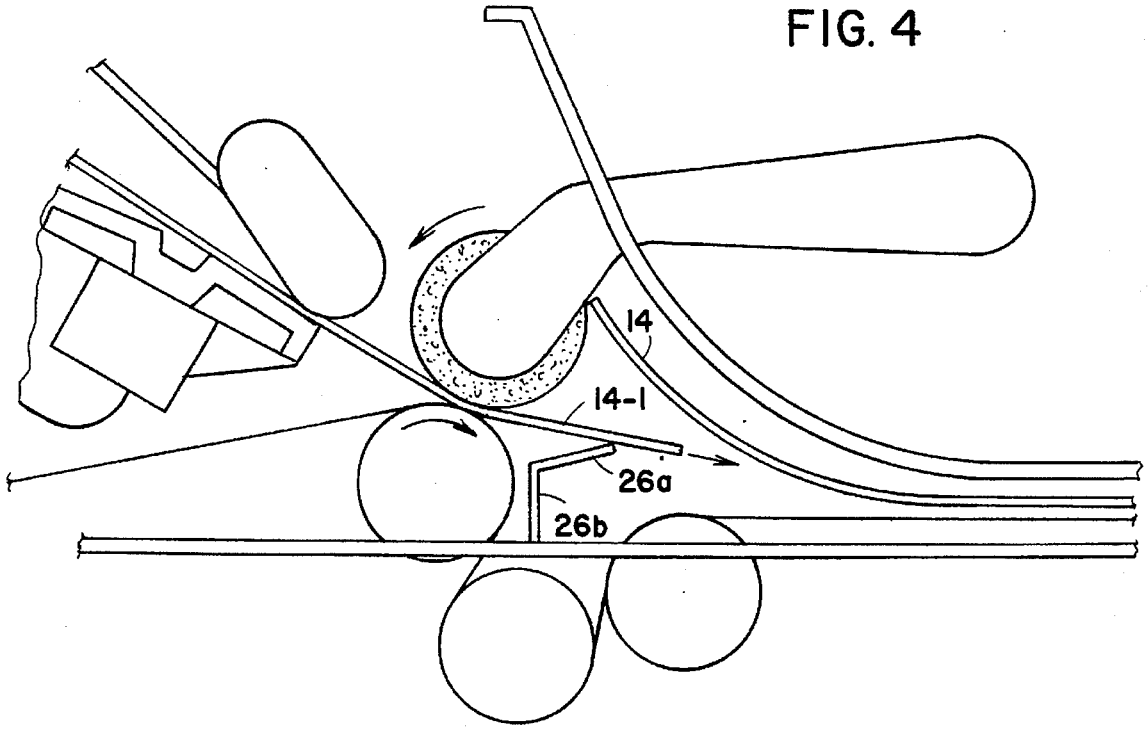

REVERSIBLE SHEET FEEDER ACCUMULATOR

BACKGROUND OF THE INVENTION

The instant invention relates to feeding and accumulating apparatus for paper sheets and more particularly to a sheet feeder and accumulator having the dual capability of stacking sheets of paper in the same or reverse order in which they are placed in the feeder.

Accumulating modules are frequently used in line with other paper handling equipment as a means of assembling a plurality of sheets of paper into a particular, desired packet prior to further processing, which may include additional collating, folding and inserting into an envelope. In a typical paper handling sequence involving an initial output consisting of a plurality of sheets of paper to be later combined with subsequent output from other sheet feeding devices situated downstream, the initial output is fed from the top of a stack seriatim to the accumulator, which accumulates the output into the desired packets in the reverse order as the sheets had when they were stacked in the hopper of the feeder. Each packet may then be folded, stitched or subsequently combined with other output from document feeding devices located downstream thereof and ultimately inserted into a mailing envelope.

A typical sheet feeder has a hopper in which documents are placed face down. The documents are removed from the hopper from the top and are conveyed to an accumulator where they are accumulated in the reverse order in which they were loaded in the feeder hopper. There are many applications in which it is desirable to have the documents arrive in the accumulator in the same order as they were placed in the feeder hopper and facing down. One option for achieving this result would be to have an additional collating module which would have reverse collating ability. Clearly, this is not a desirable option for users of paper handling equipment.

Accordingly, the instant invention provides apparatus to be used with a sheet feeder and accumulator which allows documents to be fed from the top of the hopper of the sheet feeder and to accumulate in the accumulator in the same order as they were placed in the feeder hopper.

SUMMARY OF THE INVENTION

Thus, the instant invention provides apparatus for accumulating paper sheets singulated from a paper sheet feeder on a registration deck. The apparatus includes: a sheet feeder for feeding the topmost paper sheet from a stack of paper sheets; an accumulator having an accumulation deck for receiving the sheets of paper from said sheet feeder; a registration stop for stopping the advance of the paper sheets along the accumulation deck; a deflector downstream of the sheet feeder and above the accumulation deck; and a pair of top and bottom rollers defining a nip, the nip being located adjacent, upstream and above the deflector and downstream of the sheet feeder. The top roller is formed from a foam, and the distance between the registration stop and the deflector is less than the length of the paper sheets, whereby each sheet fed from the sheet feeder is stopped by the registration stop and the trailing edge of the stopped sheet is kicked up by the deflector off the accumulation deck and is raised further off the accumulation deck by the top, foam roller, and whereby the paper sheets accumulate on the accumulation deck in the same order as when the sheets were in the sheet feeder.

BRIEF DESCRIPTION OF THE DRAWINGS

FIG. 3 is an enlarged, side elevational view of the deflector and rollers associated with the sheet feeder and shows the initial resting position of a paper sheet after it has passed over the deflector and then the final position after the foam roller has rotated the trailing paper edge upward;

FIG. 4 is similar to FIG. 3 but shows a second sheet entering the accumulator beneath the flipped up, trailing edge of the first sheet;

DETAILED DESCRIPTION OF THE PREFERRED EMBODIMENT

Figure 1:
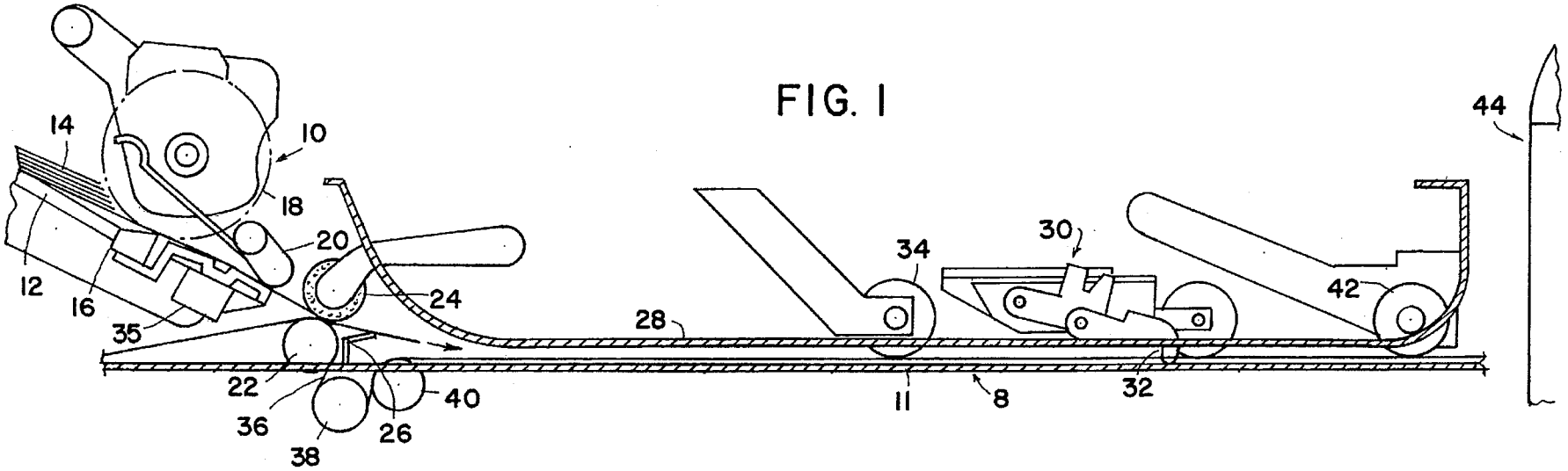
FIG. 1 is a side, elevational view of a sheet feeder and accumulator in accordance with the instant invention showing a sheet being singulated from the sheet feeder.

In describing the preferred embodiment, reference is made to the drawings, wherein there is seen an accumulator 8 having a deck 11 and a sheet feeder generally designated 10 having a hopper 12 above the deck 11 for storing a stack 13 of paper sheets 14 face down. The feeder 10 also includes a separator stone 16 and an associated separator wheel 18 for feeding the top-most sheet 14 from the stack 13. The sheet feeder 10 also includes, downstream of the separator wheel 18, a pivotable double detector 20 which identifies situations in which two sheets 14 are accidentally fed from the hopper 12. Downstream of the double detector 20 and part of the accumulator 8 are a leap frog roller 22 and an associated leap frog pressure roller 24 formed from a plastic foam, Referring now to the accumulator 8, downstream and adjacent the two rollers 22 and 24 is a deflector 26 extending from the deck 11 Located above the deck 11 is a wire paper guide 28 leading to a queuing device 30 having pivotable stops 32. Pressure rollers 34 are situated just upstream of the queuing device 30. A bar code detector 35 is situated beneath the double detector 20. A pair of continuously running flat belts 36 engage the leap frog roller 22 which in turn drives the foam pressure roller 24. The belts 36 are trained over pairs of pulleys 38 and 40 and the feeder deck 11 in order to move the paper sheets 14 along the deck 11. A pair of pressure rollers 42 sit above the flat belts 36 downstream of the queuing device 30 to aid in feeding the paper sheets 14 downstream to a folder module 44.

Figure 2:
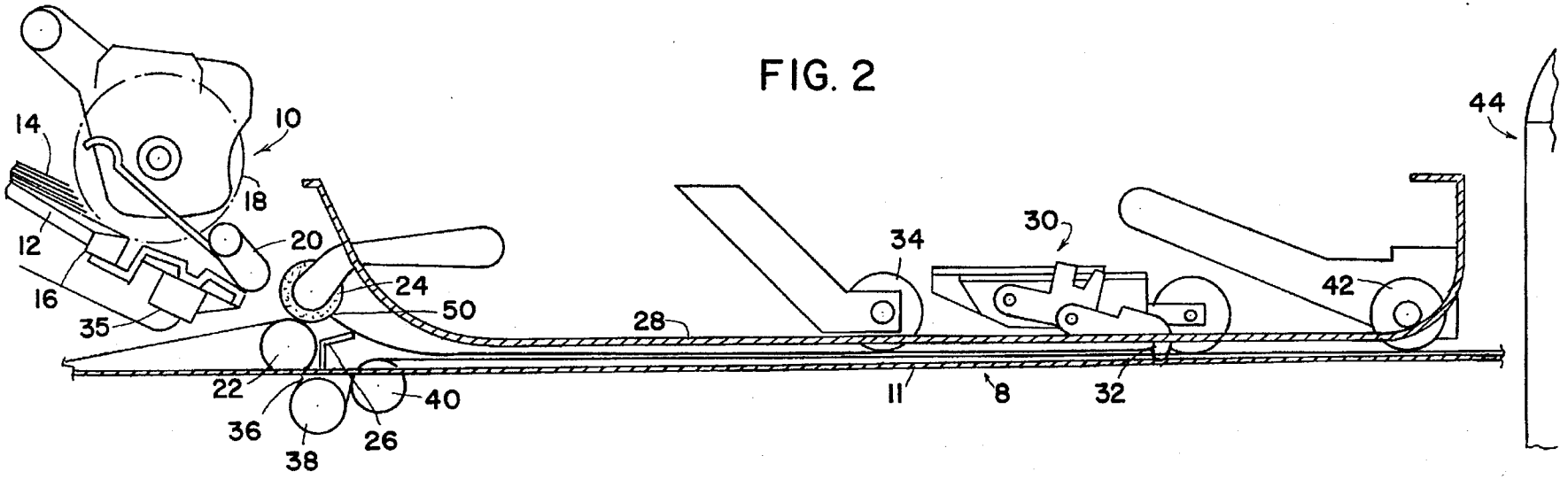
FIG. 2 is similar to FIG. 1 but shows the singulated sheet with its trailing edge flipped upward by the deflector.

The deflector 26 includes two legs **26*a* and 26*b* as best seen in FIGS. 3 and 4. The deflector leg 26*b* is substantially vertical and the deflector leg 26*a* forms an obtuse angle with the leg 26*b*. The pair of leap frog rollers 22 and 24 engage the paper sheets 14 as soon as they are singulated by the separator wheel 18 of the sheet feeder 10 from the top of the stack 13 and feed the sheets 14 over the deflector leg 26*a* and onto the deck 11 and flat belt 36, as shown in FIG. 1. Continued feeding of the sheets 14 by the rollers 22 and 24 brings the sheets 14 to the position seen in FIG. 2, i.e. the front edge of the sheet 14 is registered against the stops 32 and the trailing edge 50 rests above the deflector leg 26*a* in contact with the lower, downstream quadrant of the foam roller 24. The continuous rotation of the foam roller 24 then drives the trailing edge 50 up to the position seen in FIG. 4, i.e. the trailing edge 50 is in contact with the upper, downstream quadrant of the foam roller 24 and the sheet 14 is raised off the deflector leg 26*a*. Referring now to FIG. 3, the position of the sheet 14 in FIG. 2 is represented by sheet 14*a* and the position of the sheet 14 in FIG. 4 is represented by sheet 14***b*. Once the sheet 14 has its trailing edge 50 kicked up as shown in FIGS. 3 and 4, a succeeding sheet 14-1 can enter onto deck 11 beneath the trailing edge 50 of the preceding sheet 14, as seen in FIG. 4. This process can be repeated many times, so that a collation 43 of sheets 14 can be built up, as seen in FIGS. 5 and 6.

Figure 5:
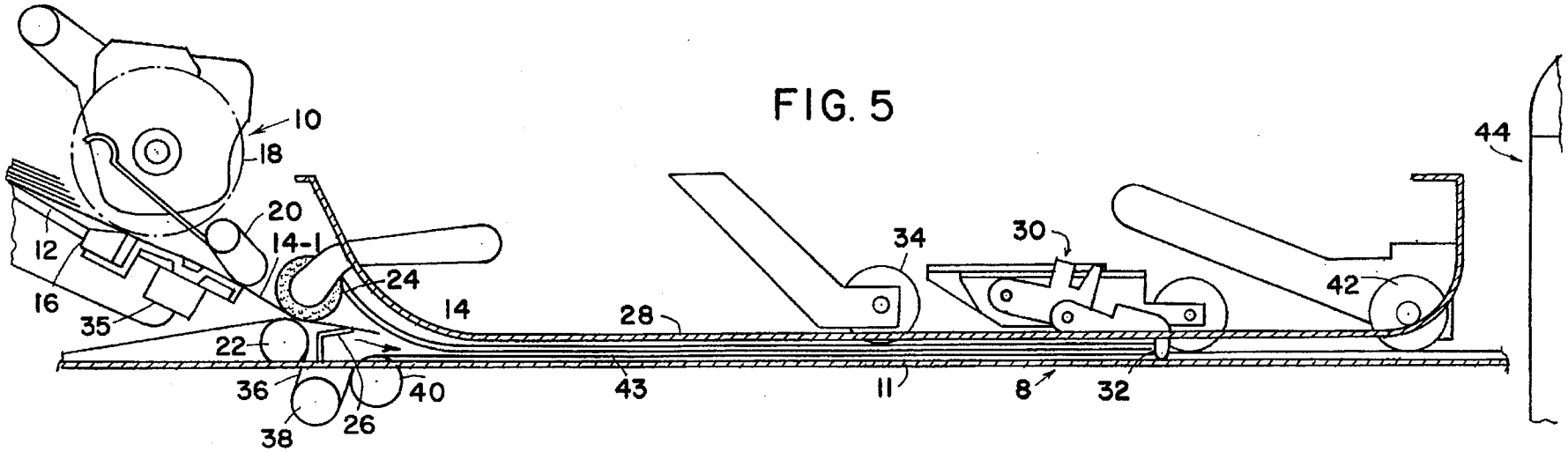
FIG. 5 is similar to FIG. 2 but shows the full position of the sheets seen in FIG. 4 stacked in the accumulator in the same order as when they were loaded in the feeder hopper.
Figure 6:
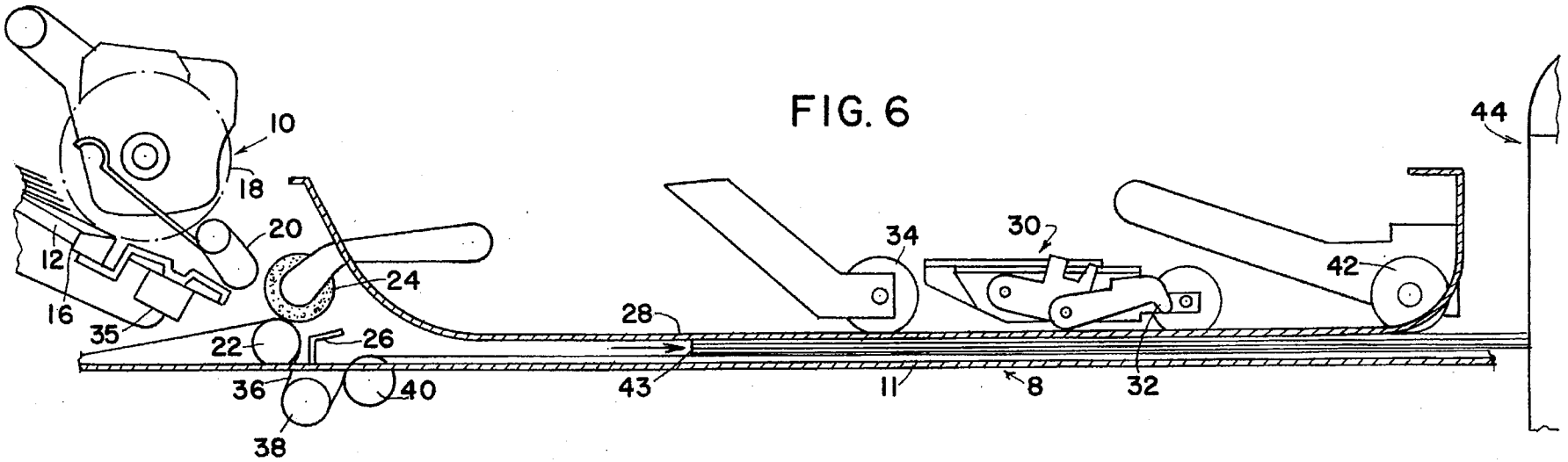
FIG. 6 is similar to FIG. 5 but shows the collation in the accumulator being moved downstream from the accumulator as the que stops are raised.

Referring now to FIG. 5, it can be seen that the first sheet 14 is stopped by the queue stops 32 so that the continuously rotating flat bells 36 cannot feed the sheet 14 further. The texture of the foam roller 24 is such that it virtually grabs hold of the trailing edge 50 of the paper sheet 14 and lifts it off the deflector leg 26*a*. Each succeeding sheet will be fed onto the deck 11 and accumulate as a collator 43 in the same order as in the feeder hopper 12 until the queue stops 32 are raised as shown in FIG. 6. Once the queue stops 32 are raised, the flat belts 36 will feed the collation 43 downstream away from the deflector 26. It can thus be seen that the sheets are accumulated into a collation 43 at the queuing device 30 in the same order as when they were in the feeder hopper 12, and face down, as in the feeder hopper 12.

In order to achieve the foregoing result, it is necessary that the distance between the queue stops 32 and the tip of the deflector leg 26*a* be less than the length of the sheets 14, so that the trailing edge 50 of the sheets 14 cannot fall below the deflector 26 which would result in the sheet 14 sitting flat on the deck 11. Although the deflector 26 is shown as comprised of two legs 26*a* and 26*b*, this is not necessary, as the shape of the deflector 26 can vary considerably; e.g. the deflector 26 could be simply arcuate in cross section, or form a T. The co-efficient of friction of the foam roller 24 assures that the tail 50 of the paper sheets 14 will be kicked up around the roller 24.

It can be seen that use of the deflector 26 causes the sheets 14 to accumulate on the deck 11 in the same order as when they were in the feeder hopper 12. The deflector 26 can be secured to the accumulator 8 in any conventional manner, or be a snap-in arrangement. In order to achieve the reverse accumulation on the deck, i.e., the sheet 14 accumulate in the reverse order as when they were in the hopper 12, it is merely a matter of removing the deflector 26. Thus, the instant invention provides apparatus and a method for accumulating sheets of paper 14 on an accumulation deck 11 in the same or reverse order in which they were placed in the feeder hopper 12.

It should be understood by those skilled in the art that various modifications may be made in the present invention without departing from the spirit and scope thereof, as described in the specification and defined in the appended claims.

What is claimed is:

1. Apparatus for accumulating paper sheets singulated from a paper sheet feeder on a registration deck, comprising:

a sheet feeder for feeding, the topmost paper sheet from a stack of paper sheets with a predetermined length;

an accumulator having an accumulation deck for receiving the sheets of paper from said sheet feeder;

a registration stop for stopping the advance of said paper sheets along said accumulation deck;

a stationary deflector downstream of said sheet feeder and above said accumulation deck; and a pair of top and bottom rollers defining a nip, said nip located adjacent, upstream and above said deflector and downstream of said sheet feeder, said top roller is formed from a foam and situated right on top of said deflector with a small gap forming therebetween to allow said paper sheets to be fed through and onto said accumulation deck, wherein a distance between said top roller and said registration stop is less than said predetermined length of said paper sheets and wherein a distance between said registration stop and said deflector is less than said predetermined length of said paper sheets, whereby each sheet fed from said sheet feeder is stopped by the registration stop and the trailing edge of said stopped sheet is kicked up by said deflector off said accumulation deck and is raised further off said accumulation deck by said top, foam roller, and whereby said paper sheets accumulate on said accumulation deck in the same order as when said sheets were in said sheet feeder.

2. The apparatus of claim 1, wherein the deflector includes a lower, substantially vertical leg and an upper leg forming an obtuse angle with said lower leg.

3. The apparatus of claim 1, additionally comprising a paper guide above said accumulation deck.

4. The apparatus of claim 1, additionally comprising a pressure roller above said deck and upstream of said registration stop.

5. The apparatus of claim 4, wherein said sheet feeder includes a double detector.

6. The apparatus of claim 5, wherein said sheet feeder includes a bar code detector beneath said double detector.

* * * * *